United States Patent [19]

Hamacher

[11] Patent Number: 4,773,465

[45] Date of Patent: Sep. 27, 1988

[54] SLIDING DOOR WITH FOLDING PANEL

[76] Inventor: Walter Hamacher, Birkengrund 2, 5100 Aachen, Fed. Rep. of Germany

[21] Appl. No.: 38,883

[22] Filed: Apr. 14, 1987

[30] Foreign Application Priority Data

May 30, 1986 [DE] Fed. Rep. of Germany ... 8614640[U]

[51] Int. Cl.[4] ..... E05D 15/26

[52] U.S. Cl. ..... 160/199

[58] Field of Search ..... 160/199, 196 R, 201, 160/206, 210, 214

[56] References Cited

U.S. PATENT DOCUMENTS

| | | | |
|---|---|---|---|
| Re. 27,066 | 2/1971 | Williams | 160/199 X |
| 3,002,218 | 10/1961 | Hollansworth | 160/199 X |
| 3,255,807 | 6/1966 | Steele | 160/201 |
| 4,359,080 | 11/1982 | Brydolf | 160/199 |
| 4,432,406 | 2/1984 | Belanger et al. | 160/199 |
| 4,574,862 | 3/1986 | Rajc | 160/199 |

*Primary Examiner*—Robert W. Gibson, Jr.

*Attorney, Agent, or Firm*—Mason, Fenwick & Lawrence

[57] ABSTRACT

A sliding door that has at least one sliding panel fixable in a locked position, and a folding panel connected by hinges to the sliding panel or to the outermost of several sliding panels. Each sliding panel is supported on a floor track by rolling supports and is guided in a ceiling track by lateral guiding rollers. In this ceiling track is provided at least one downwardly projecting abutment section disposed above the upper end plane of a lateral guiding roller or the mounting for this roller projecting beyond same. This mounting can have a ball-shaped head or a freely rotatably supported ball.

17 Claims, 1 Drawing Sheet

SLIDING DOOR WITH FOLDING PANEL

Figure 1:
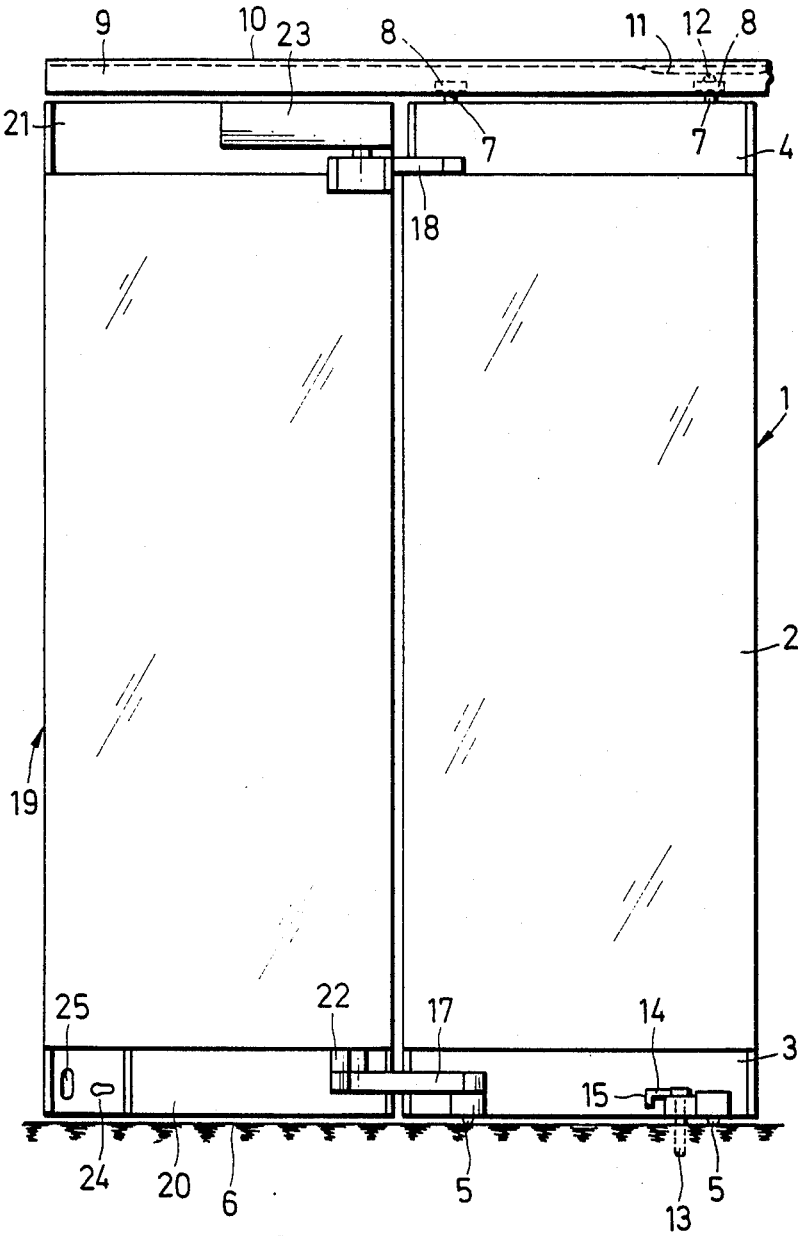

The invention concerns a sliding door with at least one sliding panel which can be fixed in at least one locked position, and a folding panel connected by hinges to the sliding panel or one of the sliding panels, each sliding panel being supported on a floor track by two rolling supports and guided in a ceiling track by two lateral guiding rollers.

In sliding doors of this kind, which can be made essentially of glass, wood or other materials, there is known the technique of providing a folding panel which can be opened by swinging in the manner of a door. This folding panel is then carried by means of hinges by a sliding panel which is supported on a floor track. The sliding panel is guided laterally by means of upper lateral guiding rollers.

In this case the folding panel always constitutes an asymmetrical load on a sliding panel, which is basically inclined to tilt. To counteract this, up to now the width of the folding panel has been designed smaller than the width of the carrying sliding panel. In this way the tendency to tilt is reduced. But it inevitably follows from this that sliding doors of this kind then have panels of different width, which is optically undesirable as a rule.

In the hitherto known sliding doors of the kind mentioned hereinbefore, the asymmetrical load on the sliding panel which carries the folding panel requires that any desired door closer for the folding panel be accommodated in a correspondingly large cavity in the floor beneath the sliding door. It is then necessary, after sliding the folding panel and carrying sliding panel, to make the connection with the door closer disposed in the floor. However, this requires considerable expenditure on assembly.

But particular problems arise with the known sliding doors of the kind mentioned hereinbefore when they are to be installed subsequently in an existing building. In that case it is often no longer possible to accommodate a door closer in the floor. In any case, fitting a door closer requires considerable preliminary work with the known sliding doors.

It is the object of the present invention, in a sliding door of the kind mentioned hereinbefore, reliably to exclude the possibility of tilting of the sliding panel which carries a folding panel.

According to the invention, in a sliding door of the kind mentioned hereinbefore, this object is achieved by the fact that in the ceiling track is provided at least one downwardly projecting abutment section which is disposed immediately above the upper end plane of a lateral guiding roller or the mounting for this roller which projects beyond same.

In this case one lateral guiding roller, namely the one which is furthest away from the folding panel, not only assumes a lateral guiding function, but also is supported against the abutment section in the desired locked position. Thus it prevents this sliding panel from performing a tilting movement corresponding to its asymmetrical load. The abutment section appropriately has a planar surface which gradually tapers off towards its ends.

As the possibility of tilting movements of the carrying sliding panel is excluded in this way, the asymmetrical load on this sliding panel is no longer critical. There is therefore no longer any need to design the folding panel narrower than the carrying sliding panel. There is no longer any special call for a reduction in weight of the folding panel.

Moreover, an abutment section of this kind can easily be fitted subsequently in existing sliding doors.

According to a further proposal, the sliding door according to the invention may be designed in such a way that the mounting for the lateral guiding roller has a ball-shaped head projecting upwardly beyond the lateral guiding roller. By this means, cooperation with the abutment section is improved.

According to a further proposal, the sliding door according to the invention may be designed in such a way that the mounting for the lateral guiding roller has a freely rotatable ball. Consequently sliding of the sliding panel can be facilitated further in the region of the abutment section.

According to a further proposal, the sliding door according to the invention may be designed in such a way that a floor bolt for locking is provided on the sliding panel which carries the folding panel. A floor bolt of this kind, for which a bore or socket may be provided in the floor region, makes it possible to lock the sliding door in one position or in several positions by simple means.

According to a further proposal, the sliding door according to the invention may be designed in such a way that a holder which locks the folding panel parallel to the sliding panel, is provided on the sliding panel which carries the folding panel. To slide the sliding door, it is advisable and simple to lock the folding panel parallel to the carrying sliding panel.

According to a further proposal, the sliding door according to the invention may be designed in such a way that the holder engages in an opening in a breast rail of the folding panel.

According to a further proposal, the sliding door according to the invention may be designed in such a way that on the folding panel is mounted a door closer which is connected by a hinge to the sliding panel.

The considerable weight of a door closer, which may be any commercially available door closer, can be taken by this sliding door without tilting movements of the sliding panel. The door closer can therefore be fixed to the folding panel. This results in appreciable facilitation of assembly.

Finally, a further proposal provides that the sliding door according to the invention may be designed in such a way that the door closer is connected to the upper hinge of the sliding panel.

With this arrangement, the door closer is least in the way. It is also readily accessible for assembly and maintenance In the following part of the specification, an embodiment of the sliding door according to the invention is described with reference to drawings.

Figure 2:
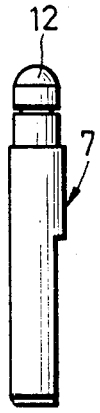

FIG. 1 shows a side view of a sliding door according to the invention, with a sliding panel and a folding panel, and FIG. 2 shows a holding pin for a lateral guiding roller.

The sliding door shown in the drawings has a sliding panel 1 with a glass pane 2, a breast rail 3 and a head rail 4. Near each end of the breast rail 3 is supported a ball-like support 5. These supports 5 are supported on a floor track 6.

Near each of the two ends of the head rail 4 of the sliding panel 1 is mounted a holding pin 7. On each of these holding pins 7 is mounted a lateral guiding roller 8. The lateral guiding rollers 8 run in an approximately inverted U-shaped ceiling track 9, and support the sliding panel 1 in its vertical position.

The ceiling track 9 has a base wall 10 with a downwardly projecting abutment section 11. The latter forms in its central region a planar abutment surface which is gradually reduced towards the inner surface of the base wall 10 at both ends.

In the case of the lateral guiding roller 8 which is furthest to the right in FIG. 1, the holding pin 7 projects upwardly beyond this roller. Here the pin has a ball-shaped head 12. This head 12 comes to rest against the planar surface of the abutment section 11, or lies only slightly below it.

Furthermore, attached to the breast rail 3 is a floor bolt 13 which can be raised and introduced into a guide bore, not shown. Also, on the breast rail 3 is provided a holder 14 which can move up and down, with a hook-like end 15.

A hinge 17, 18 is attached in the conventional manner to each of the left-hand ends of the breast rail 3 and head rail 4 in FIG. 1.

The lower hinge 17 and the upper hinge 18 carry a folding panel 19, which may have the same structure and dimensions as the sliding panel 1, but does not carry any supports 5 or lateral guiding rollers 8.

The folding panel 19 also has a breast rail 20 and a head rail 21. At one end of the breast rail 20 is mounted a hinge 22 which is hinged to the lower hinge 17 of the sliding panel 1.

Fixed to the head rail 21 above the hinge 22 is a door closer 23 of conventional design, which cooperates in the conventional manner with the upper hinge 18 of the sliding panel 1.

Near the left-hand end of the breast rail 20 in FIG. 1, this rail is provided in the conventional manner with a floor lock 24 and a through-slot 25. The hook-like end 15 of the holder 14 can engage in this slot 25 when the folding panel 19 is swung into a position parallel to the sliding panel 1.

I claim:

1. A sliding door having at least one sliding panel which can be fixed in a locked position, and a folding panel connected by hinges to a sliding panel being supported on a floor track by rolling supports and guided in a ceiling track by lateral guiding rollers, said track having at least one downwardly projecting abutment section disposed above the uppe end plane of a lateral guiding roller or the mounting for this roller thereby counteracting the inclination of said sliding panel to tilt.

2. A sliding door according to claim 8, wherein said sliding panel has a breast rail having an opening wherein said holder engages.

3. The sliding door of claim 1 wherein said downwardly projecting abutment section is disposed above the lateral guiding roller furthest away from the folding panel.

4. The sliding door of claim 1 wherein said abutment section has a planar surface that gradually tapers off toward an end of said abutment section.

5. A sliding door according to claim 1, wherein the mounting for the lateral guiding roller has a ball-shaped head projecting upwardly beyond the lateral guiding roller.

6. A sliding door according to claim 1 wherein the mounting for the lateral guiding roller has a freely rotatable ball.

7. A sliding door according to claim 1, wherein a floor bolt for locking said sliding door is provided on the sliding panel which carries the folding panel.

8. A sliding door according to claim 9, wherein said sliding panel has a holder that locks said folding panel parallel to said sliding panel is provided on the sliding panel which carries the folding panel.

9. A sliding door according to claim 8, wherein a door closer is mounted on said folding panel, said door closer being connected by a hinge to said sliding panel.

10. A sliding door according to claim 9, wherein said door closer is connected to the upper hinge of the sliding panel.

11. A sliding door according to claim 5, wherein a floor bolt for locking said sliding door is provided on the sliding panel which carries the folding panel.

12. A sliding door according to claim 6, wherein a floor bolt for locking said sliding door is provided on the sliding panel which carries the folding panel.

13. A sliding door according to claim 6, wherein a holder that locks the folding panel parallel to the sliding panel is provided on the sliding panel which carries the folding panel.

14. A sliding door according to claim 5, wherein a holder that locks the folding panel parallel to the sliding panel is provided on the sliding panel which carries the folding panel.

15. A sliding door according to claim 1, wherein a holder that locks the folding panel parallel to the sliding panel is provided on the sliding panel which carries the folding panel.

16. A sliding door according to claim 6 wherein a door closer is mounted on said folding panel, said door closer being connected by a hinge to the sliding panel.

17. A sliding door according to claim 6, wherein a door closer is mounted on said folding panel, said door closer being connected by a hinge to the sliding panel.

* * * * *